US007669754B2

(12) United States Patent
Teixidor Casanovas et al.

(10) Patent No.: US 7,669,754 B2
(45) Date of Patent: Mar. 2, 2010

(54) SELF-MOUNTING AND COLLAPSIBLE TRAY, AND PROCEDURE FOR THE OBTAINING THEREOF

(75) Inventors: Pedro Teixidor Casanovas, Villana (ES); Fernando Manuel Canales Cañas, Villana (ES)

(73) Assignee: Videcart. S.A., Navarra (ES)

( * ) Notice: Subject to any disclaimer, the term of this patent is extended or adjusted under 35 U.S.C. 154(b) by 768 days.

(21) Appl. No.: 11/542,743

(22) Filed: Oct. 4, 2006

(65) Prior Publication Data

US 2007/0080198 A1 Apr. 12, 2007

(30) Foreign Application Priority Data

Oct. 6, 2005 (EP) ..... 05380215

(51) Int. Cl.
*B65D 5/36* (2006.01)
*B65D 5/28* (2006.01)

(52) U.S. Cl. ..... 229/117.03; 229/117.07; 229/191; 229/918; 229/117.01

(58) Field of Classification Search ..... 229/117.03, 229/117.07, 191, 918, 117.09, 117.01, 917
See application file for complete search history.

(56) References Cited

FOREIGN PATENT DOCUMENTS

| | | |
|---|---|---|
| DE | 33 21 614 | 12/1984 |
| EP | 0 394 549 | 10/1990 |
| EP | 0 453 015 | 2/1996 |
| GB | 2 205 083 | 11/1988 |
| NL | 9000063 | 4/1990 |

*Primary Examiner*—Gary E Elkins
*Assistant Examiner*—Latrice Byrd
(74) *Attorney, Agent, or Firm*—Katten Muchin Rosenman LLP

(57) ABSTRACT

The self-mounting and collapsible tray has a base (1), two side walls (2) and two end walls (3), as well as, in correspondence with each corner, a corner pillar which comprises at least four segments (41-44) separated by fold lines (**4*a*-4*c***).

The last segment (44) is affixed to the end wall so that at least one part of the last segment extends from one of the intermediate segments (43) and toward the center of the end wall, distancing itself from the corresponding corner of the tray. In addition, the tray comprises, in correspondence with each end wall (3), a transversal flap (5) constituted by at least one part of a prolongation of the end of the end wall which corresponds to the upper part of the end wall of the tray in the erect position, said transversal flap (5) having two ends (51), each folded over and affixed to an outside face of the corresponding side wall (2).

23 Claims, 14 Drawing Sheets

SELF-MOUNTING AND COLLAPSIBLE TRAY, AND PROCEDURE FOR THE OBTAINING THEREOF

CROSS REFERENCE TO RELATED APPLICATION

This application claims priority from European Application 05380215.3 filed Oct. 6, 2005, the contents of which are herein incorporated by reference.

TECHNICAL FIELD OF THE INVENTION

The invention is included in the field of self-mounting and collapsible trays, that is, in the field of the trays which are glued and folded in origin and which are then transported, glued and folded, to a user that can "mount" the tray by simply erecting it, without having to glue the different parts of the tray. This type of tray is habitually used for the transport of fruit or vegetables.

BACKGROUND OF THE INVENTION

For the transport of fruit and vegetables a great variety of stackable compact cardboard trays is known, obtained from one or several pieces. Some of these trays are transported to the end user in the form of a stamped sheet of cardboard, with fold lines. The end user mounts the tray in situ, using a special machine and carrying out the gluing of the parts which require to be joined by means of adhesive. Logically, this signifies an additional expense for the end user, who not only requires special machinery but must also undertake the gluing process, etc.

On the other hand, there are the so-called self-mounting and collapsible trays which are glued and folded in origin (since, logically, the empty trays should not be transported erected or mounted, as they would occupy a lot of space) and which are designed for their assembly (self-mounting) in the factory or premises of the end user. That is, these trays are transported to the user already glued and folded, so that in the transport thereof the space occupied is reduced, and the assembly thereof only comprises the erection of the tray. Logically, the trays of this type comprise special means to allow their folding and gluing, by means of a special folder, which means are generally constituted by fold lines, arranged in certain areas of the tray. These trays also usually have means which allow the stabilization of the erect position of the tray, thereby avoiding that the trays, when erected, return to the folded position by the effect of the fold lines and by their tendency to resume the folded position in which they were transported and stored. These means are usually constituted by reinforced corner pillars, of triangular or quadrangular cross-section and which have means of support in the erect position of the tray, which can be flaps or tabs which are lodged in corresponding slots. Examples of said type of tray are described in the patent applications with publication no. GB-A-2205083, EP-A-0394549 and DE-A-3321614.

The stabilization of the corner pillars, in the erect position, can also be achieved by using corner pillars consisting of four sides or segments, two of them fixed to the walls of the box in the area of the corner, with the particularity that the other two sides are narrower than the sides or segments which abut against the walls, in such a way that they allow their folding, about a central folding line, both inwards and outwards with respect to the corresponding corners. When the narrower sides are folded toward the exterior (that is, toward the centre of the tray), they pull the actual walls (that is, the side walls and the end walls) of the box toward the inside thereof, favouring the folding, whilst when they are folded toward the interior (that is, toward the corner), they maintain the box erect, that is, they lock it in its erect position. For this reason, the width of the two narrower sides is slightly greater than the length of the hypotenuse of a hypothetical triangle which would be formed between the corresponding ends of the longer sides abutting on the walls of the box. For the erection of the box, one has to press on the narrower sides of the corner pillar (the imaginary hypotenuse) until suddenly they fold inwards (that is, toward the corresponding corner). Solutions of said type are described in, for example, the patent applications with publication no. NL-A-9000063 and EP-A-0453015.

DESCRIPTION OF THE INVENTION

As can be observed in, for example, EP-A-0453015, this type of tray usually has each corner pillar formed from a side flap of the end wall, which is folded forming four segments, one which is affixed to a side wall of the tray, followed by two "free" segments which form the "hypotenuse" mentioned above, and a last segment which is folded toward the corner of the tray and which is affixed to the end wall, whereby it is housed "inside" the corner pillar. This signifies that the width or length of this last segment, in the horizontal sense (of the mounted tray), is reduced, since the quarter segment has to fit "inside" the corner pillar. This can imply a restriction when designing a tray in which it is desired to reinforce the end wall, by making use of this quarter segment for such purpose. In addition, said configuration means much material accumulates in the corner (since the last segment is located between the other segments, the side wall and the end wall), which makes folding difficult. This can be resolved by making a hole of considerable size in the corner, but this in turn reduces the compressive strength (when stacking) of the corner and, therefore, of the tray.

On the other hand, the tray described in EP-A-0453015 also has a flap formed by a longitudinal prolongation of the end wall, and which in the erect tray is positioned horizontally, extending along the end wall and covering the corner pillars. The side ends of this flap are folded through 90°, downwards, and each of these ends is affixed to the inside wall of the corresponding side.

However, this form of affixing the flaps means it is relatively easy that they become detached from the sides of the tray, if these suffer an outward pull, or if the product in the tray applies a considerable "outward force" on the walls of the tray.

A first aspect of the invention refers to a self-mounting and collapsible box or tray, that is, to a tray of the type which is folded and glued in origin and which can then be mounted or erected by the user, with no need for gluing machinery, etc. Specifically, it is a self-mounting and collapsible box or tray obtained or attainable from a stamped board or sheet, for example, of cardboard or similar, and which comprises a base (which constitutes the bottom of the tray), two side walls and two end walls, and also four corners in correspondence with which the side walls are joined to the end walls. The tray comprises, in correspondence with each corner, a corner pillar formed from a flap or side prolongation of the corresponding end wall of the tray, said side prolongation of the end wall comprising at least four segments separated by fold lines, of which at least one first segment is affixed or stuck to the corresponding side wall (with adhesive, for example), at least two intermediate segments constitute a part of the corner pillar which extends between the side wall and the end wall of the tray in the erect position, and at least one last segment is affixed to the end wall.

Thus, and with the tray in the erect position, said intermediate segments can be located in a first position in which the corner pillars lock the tray in its erect position, and a second position in which they allow the tray to be folded, the side walls and the end wall being folded toward the base. The configuration of the intermediate segments as well as the way in which said configuration serves to lock/not lock the tray in its erect configuration, can be like that which has been described above, that is, based on a triangular configuration of the corner pillar with a "hypotenuse" which can be "folded inwards" (toward the corner), whereby the locking function is attained, or "outwards" (toward the centre of the box), whereby it no longer locks the end wall and corresponding side wall in the erect position.

In accordance with the invention, the last segment is affixed to the end wall so that a part or the entirety of the last segment extends from one of the intermediate segments and toward the centre of the end wall, distancing itself from the corresponding corner of the tray. Thus, the last segment is not "hidden" inside the corner pillar, but rather it remains outside the corner pillar, extending along the end wall, toward its centre or even as far as its centre, if this is deemed appropriate. Thus, the length of said last segment is not limited by the lengths of the other segments of the corner pillar, but rather it can be chosen freely, according to the degree to which it is desired to use said last segment for additionally reinforcing the end wall. This substantially increases the possibilities of optimising several aspects of the tray, including the strength thereof.

Moreover, this configuration allows the material of the corner pillar to be distributed (since the last segment is not lodged inside the corner pillar, that is, between the other segments and the end wall), which facilitates the folding of the box, with no need to make holes in the corners.

The tray comprises additionally, in correspondence with each end wall, a transversal flap constituted by at least one part of a prolongation of the end of the end wall which corresponds to the upper part of the end wall of the tray in the erect position. Said transversal flap has two ends, each folded over and affixed (for example, with adhesive) to an outside face of the corresponding side wall. Thus, the transversal flap with its ends can increase the strength of the tray and make it more resistant to "outward" pulling of the side walls, as well as to the "outward" forces which the content of the tray can apply on said walls, for example.

This tray proves practical and useful for the transportation of fruit and vegetables.

Optionally, each of said flaps can have a substantially horizontal surface in the tray in the erect position; this surface can, for example, be located at the level of the upper edge of the corresponding end wall.

Optionally, each of said flaps can have a hole in correspondence with each corresponding corner pillar. In addition, each corner pillar can have, in correspondence with an upper edge of the intermediate segments, a prolongation configured to pass through the corresponding hole, in the erect position of the tray. The holes of the flap and the prolongations of the corner pillars can be configured so that, with the tray in the erect position, the prolongations are horizontally displaceable within the holes, so that by pressing on the prolongations, the intermediate segments of the corner pillars can be displaced between the first position and the second position. Therefore, said configuration can facilitate the placement of the corner pillars in the position in which they maintain the tray erect and in the position in which they allow its folding, respectively.

The tray can have, in its base and in correspondence with each corner pillar, a through-hole configured so that, when a first tray is piled on an identical second tray, said through-hole of the first tray receives the prolongation of the upper edge of the intermediate segments of said second tray. The lengths and the location of said through-hole can be such that they prevent the intermediate segments of said second tray from passing from the first position (in which they lock the tray in its erect position) to the second position (in which they allow the folding or collapse of the tray).

The hole which each flap has in correspondence with each corresponding corner pillar, can be located and configured so that when the intermediate segments are in the first position in which the corner pillars lock the tray in its erect position, an edge of said hole acts as a butt against the prolongation of the upper edge of the intermediate segments, so that said prolongation tends to incline toward the centre of the tray. In this way one achieves that on stacking a first tray on a second identical tray (and both trays having their intermediate segments of the corner pillars in their first position), the prolongation of the upper edge of the intermediate segments of the second tray passes through the hole in the base of the first tray and is located exactly in front (toward the centre of the tray) of the intermediate segments of the first tray, whereby it serves to lock said segments in said first position.

An alternative or complementary form of "locking" a box in the mounted position and avoiding its collapse during the use thereof, can consist in appropriately configuring the holes in the flaps, to retain the prolongations of the corner pillars when the intermediate segments of the corner pillars are in their first position. That is, the hole which each flap has in correspondence with each corner pillar can be configured to retain the prolongation of the corresponding corner pillar in the first position of the corner pillar, impeding the intermediate segments of the corner pillar from passing from the first position to the second position. For example, said hole can have, in correspondence with an edge of the hole, two notches configured to retain the prolongation of the corresponding corner pillar, impeding the intermediate segments from passing from the first position to the second position.

The flaps can have, in correspondence with each corner of the tray, a folding line which extends at an angle from the corresponding corner, passing through the corresponding hole. Each side can have, in correspondence with each corner, a folding line which extends at an angle from the corresponding corner, toward an upper edge of the side. These lines facilitate the folding of the tray.

Each side can have a part of longitudinal reinforcement which comprises an upper prolongation of at least one part of the side, folded over a wall of the side and at least partially affixed to the same, with adhesive.

The tray can have, on an inside surface of the base and in correspondence with each of the corner pillars, at least one area coated with a material (for example, silicone) which has a surface with a coefficient of friction lower than the coefficient of friction of the rest of the inside surface of the base. In this way, it is made easier for the corner pillars to slide on said surface during the folding of the tray.

Another aspect of the invention refers to a procedure for obtaining a self-mounting and collapsible tray (for example, a tray like that which has been described above) starting from a stamped sheet (for example, of cardboard), the tray comprising a base, two side walls and two end walls, the tray also comprising four corners in correspondence with which the side walls are joined to the end walls. Additionally, the tray comprises, in correspondence with each corner, a corner pillar formed from a side prolongation of the corresponding end wall of the tray, said side prolongation of the end wall comprising at least four segments separated by fold lines.

In accordance with the invention, the procedure comprises the steps of:

a) folding said side prolongation of each end wall over an inside face of the end wall and affixing, with an adhesive, at least one last segment of said side prolongation of the end wall on said inside face of the end wall, so that at least one part of said last segment extends from an adjacent intermediate segment of the side prolongation of the end wall, toward a centre of the end wall, distancing itself from the corresponding corner of the tray, so that a corner pillar is established in which at least two intermediate segments are not joined to an end wall or to a side wall;

b) locating or arranging the side walls and the end walls in a position substantially perpendicular with respect to the inside surface of the base, in a position substantially corresponding to the erect position of the tray, and affixing, with adhesive, at least one first segment of each side prolongation of the end wall, to an inside face of the corresponding side wall;

c) folding a prolongation of the end of each end wall which corresponds to the upper part of the end wall of the tray in the erect position, so that said prolongation extends by way of a transversal flap between the side walls of the tray;

d) folding at least two ends of each of said prolongations of the ends of the end walls over an outside face of the corresponding side wall, and affixing said ends to the corresponding outside face, with adhesive; and e) folding the side walls and the end walls so that a substantially flat folded tray is obtained (that is, in said step the collapsing of the tray is carried out).

What has been outlined above with respect to the tray is also applicable to the procedure, mutatis mutandis. For example, step d) allows the strength of the tray to be increased against "outward forces" applied on the walls of the tray.

Steps c) and d) can be carried out so that each of the transversal flaps has a substantially horizontal surface in the tray in the erect position; for example, step c) can be carried out so that the substantially horizontal surface is located at the level of the upper edge of the corresponding end wall.

The affixing of the ends of each of said prolongations of the ends of the end walls on an outside face of the corresponding side wall can only be done with the end wall and the side walls raised, that is, at an angle (approximately perpendicular) to the base, which signifies an important innovation in this field, in which the trays have been traditionally folded and glued when flat, that is, without the end walls and the side walls being raised during the process.

When carrying out the procedure, one can start with a sheet in which each of the prolongations that constitute said flaps has, in correspondence with each corresponding corner pillar, a hole. In addition, each side prolongation of the end walls intended to form a corner pillar can have, in correspondence with an upper edge of its intermediate segments, a prolongation configured to extend through the corresponding hole, in the erect position of the tray. In this way, the holes of the flap and the prolongations configured to extend through the holes can be configured so that, with the tray in the erect position, the prolongations are displaceable horizontally within the hole, so that by pressing on the prolongations the intermediate segments of the corner pillars can be displaced between the first position and the second position.

It is possible to start with a sheet in which the hole which each flap has in correspondence with each corner pillar is configured to retain the prolongation of the corresponding corner pillar in the first position of the intermediate segments of the corner pillar, impeding said intermediate segments from passing from the first position to the second position. For example, said hole can have, in correspondence with an edge of the hole, two notches configured to retain the prolongation of the corresponding corner pillar.

It is possible to start with a sheet in which the flaps (or the parts intended to form the flaps) have, in correspondence with each corner of the tray, a fold line which extends at an angle from the corresponding corner, passing through the corresponding hole.

It is possible to start with a sheet in which each side wall has, in correspondence with each corner, a fold line which extends at an angle from the corresponding corner, toward an upper edge of the side wall.

The procedure can additionally comprise the step of folding a prolongation or upper part of at least one part of each side wall, over a face (interior or exterior) of the side wall, and at least partially affixing said upper part to said face, with adhesive.

The procedure can additionally comprise the step of providing an inside surface of the base in correspondence with each of the corner pillars, with at least one area coated with a material (for example, silicone) which has a surface with a coefficient of friction lower than the coefficient of friction of the rest of the inside surface of the base.

Said step of providing said inside surface of the base with said coated area, has to be carried out before a step which comprises the folding of the end wall and of the side walls on the base, in order to form a substantially flat folded tray (it can be practical to provide the base with said coated area in an initial phase of the process, specifically, in the phase in which one has a flat sheet still unfolded). In this way, the sliding surface serves to facilitate the folding of the tray.

The procedure can additionally comprise the step of applying at least one suction pad on an external surface of the base to curve at least one corresponding part of the base, to facilitate the folding of the tray, since in this way the friction is reduced between the corner pillars and the bottom of the tray.

DESCRIPTION OF THE DRAWINGS

To complete the description that is being made and with the object of assisting in a better understanding of the characteristics of the invention, in accordance with a preferred example of practical embodiment thereof, accompanying said description as an integral part thereof, is a set of drawings wherein, by way of illustration and not restrictively, the following has been represented.

PREFERRED EMBODIMENT OF THE INVENTION

Figure 1:
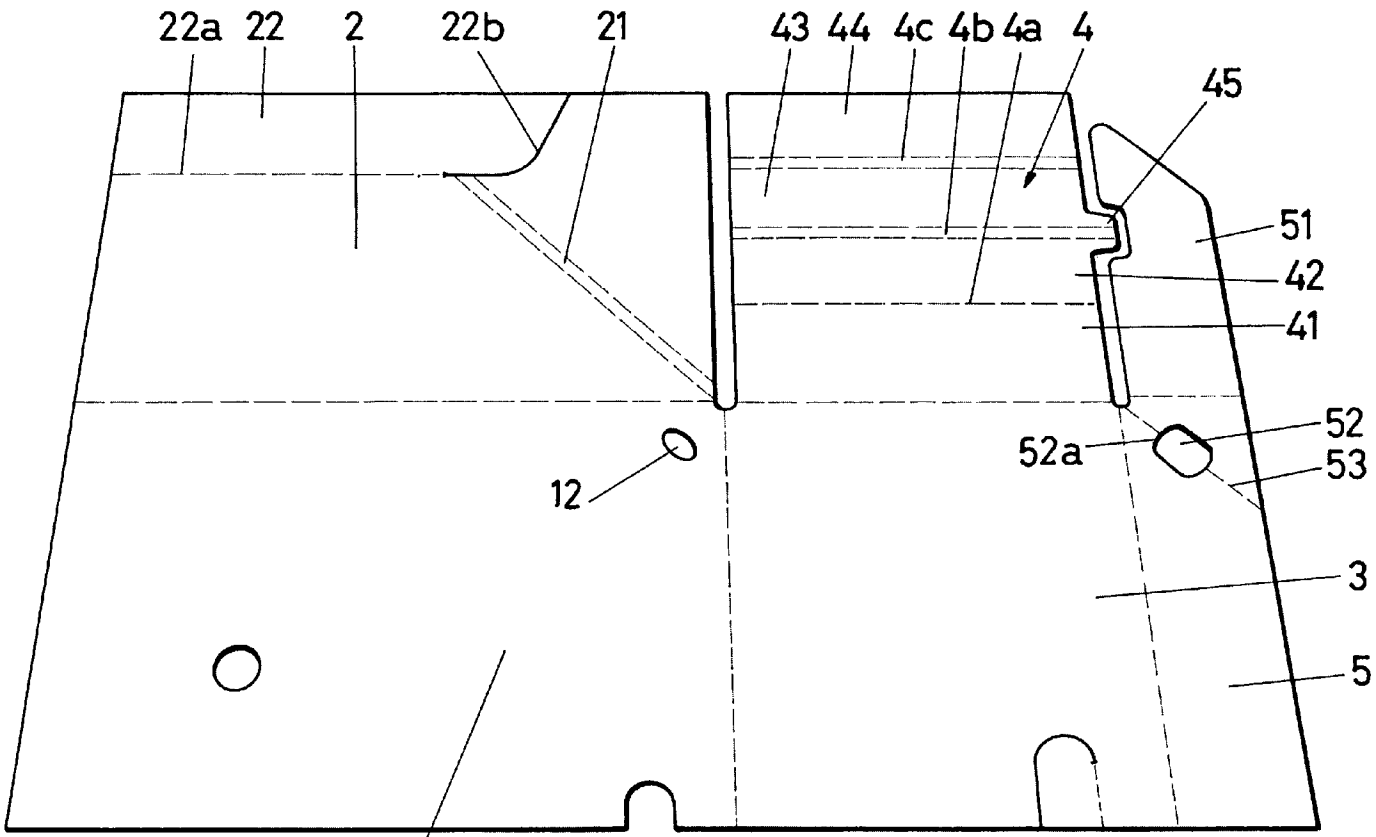
FIGS. 1-10. —They show schematically a quarter part of a tray according to a preferred embodiment of the invention, during different steps of the procedure for obtaining the same from a stamped sheet.

FIG. 1 illustrates schematically a quarter part of a cardboard sheet to form a self-mounting and collapsible tray according to a possible embodiment of the invention. The other three quarter parts of the sheet are identical, for which reason it is sufficient to describe the invention with respect to the quarter part shown of the same.

As one can observe in FIG. 1, it concerns a stamped cardboard sheet with a number of fold lines, along which the different parts of the tray are folded, in connection with the process for obtaining the same.

As can be seen from FIG. 1, the sheet comprises a base 1 (a quarter part of which is observed in FIG. 1), two side walls 2 (half of one of which is observed in FIG. 1) and two end walls 3 (half of one of which is observed in FIG. 1). In addition, the tray has four corners in correspondence with which the side walls 2 are joined to the end walls 3, in the fabricated tray (in FIG. 1, the side walls have not yet been joined to the end walls).

The sheet or board comprises, in correspondence with each corner, a corner pillar which is formed from a side prolongation 4 (which can be observed in FIG. 1) of the corresponding end wall 3 of the tray. Each side prolongation has four segments 41-44 separated by fold lines (4*a*-4*c*), of which, in the finished tray, a first segment 41 will be affixed to the corresponding side wall 2, two intermediate segments 42, 43 will constitute a part of the corner pillar which extends between the side wall 2 and the end wall 3 of the tray in the erect position, and a last segment 44 will be affixed to the end wall 3.

Thus, with the tray in the erect position, the intermediate segments 42, 43 can be located in a first position in which the corner pillars lock the tray in the erect position thereof, and a second position in which it is permitted that the tray be folded.

In addition, in FIG. 1 one can observe how the stamped sheet comprises, in correspondence with each end wall 3, a transversal flap 5 which is constituted by a longitudinal prolongation of the end of the end wall which corresponds to the upper part of the end wall of the tray in the erect position. This transversal flap 5 has two end segments 51. The flap has, in correspondence with each corner, a through-hole 52. A fold line 53 extends from the corner and passes through said hole 52.

Finally, one can observe how each side wall 2 has an upper part 22 with its corresponding fold line 22*a* and cutting line 22*b*. This part corresponds to only one part of the longitudinal extension of the side wall 2, as one observes in FIG. 1.

In addition, the tray has, on its base and in correspondence with each corner pillar, a through-hole 12 configured so that, when a first tray is piled on an identical second tray, said through-hole of the first tray receives the prolongation 45 of the upper edge of the intermediate segments 42, 43 of said second tray. The dimensions and the location of this through-hole 12 are such that they prevent the intermediate segments of said second tray from passing from the first position (in which they lock the tray in its erect position) to the second position (in which the folding or collapse of the tray is allowed).

The hole 52 which each flap 5 has in correspondence with each corresponding corner pillar, is located and configured so that, with the tray erect, when the intermediate segments are in the first position in which the corner pillars lock the tray in its erect position, an edge 52*a* of said hole acts as a butt against the prolongation 45 of the upper edge of the intermediate segments, so that said prolongation 45 tends to incline toward the centre of the tray. Thus it is possible that when stacking a first tray on an identical second tray (and both trays having their intermediate segments of the corner pillars in their first position), the prolongation 45 of the upper edge of the intermediate segments of the second tray passes through the hole in the base of the first tray and is located precisely in front (toward the centre of the tray) of the intermediate segments of the first tray, whereby it serves to lock said segments in said first position.

Figure 2:
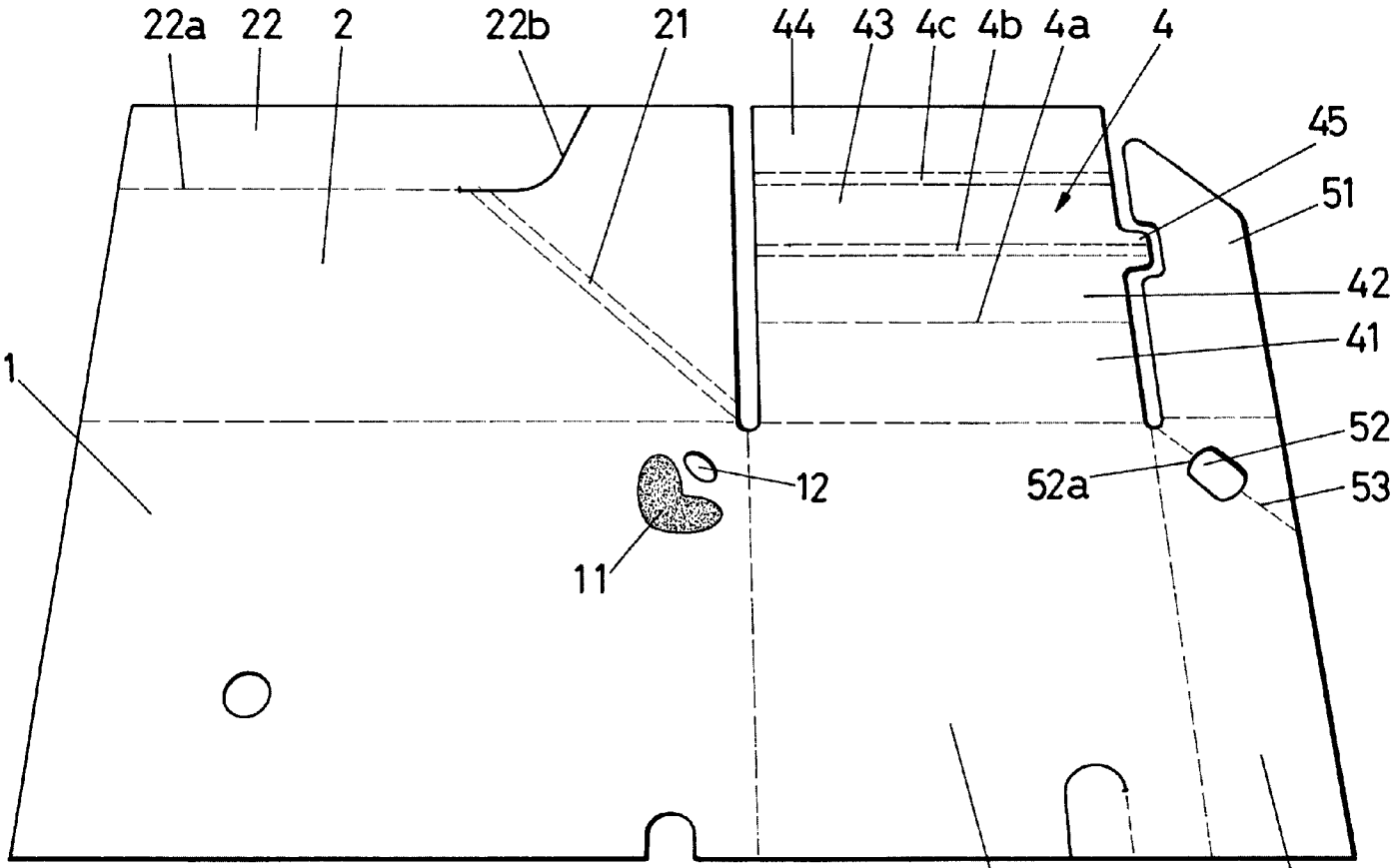

FIG. 2 shows how silicone has been applied on an area 11 of the inside surface of the base 1, in correspondence with the corner, to facilitate the folding of the box, as will be explained below. The same thing is done in correspondence with the other three corners (as has already been mentioned, it is a symmetrical box; the quarter part shown is identical to the other three quarter parts).

Figure 3:
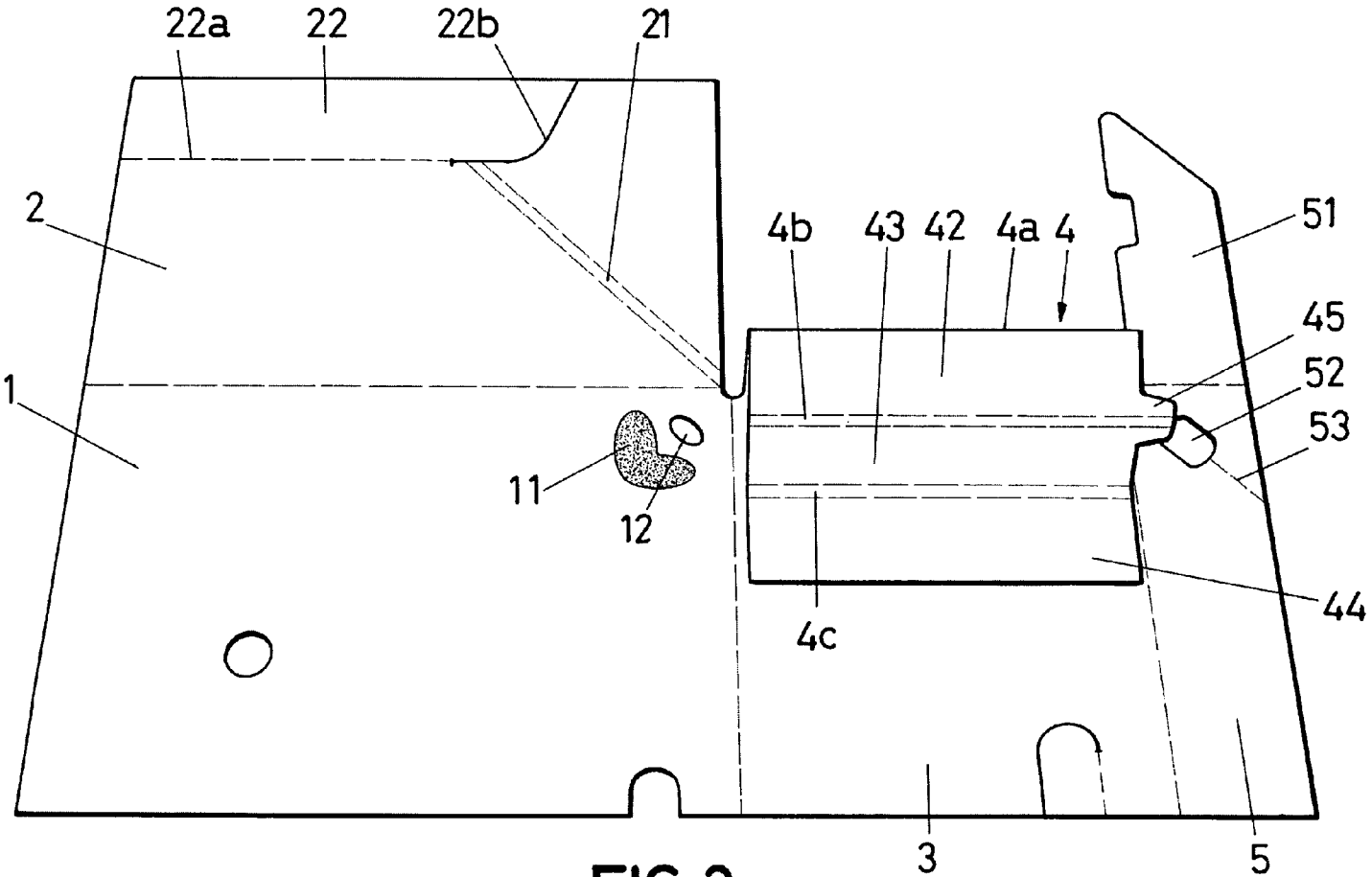

In FIG. 3 it is illustrated how the side prolongation 4 of the end wall has been folded over the inside face of the end wall. The last segment 44 is secured to this inside face of the end wall with adhesive, so that from the fold line 4*c*, this last segment 44 extends toward the centre of the end wall (and not toward the corner, as in the case of the state of the art cited above). In this way, the length of segment 44 does not depend on the lengths of the other segments 41, 42 and 43, but instead it can be chosen freely, in terms of design criteria and of the need to reinforce the end wall internally.

Figure 4:
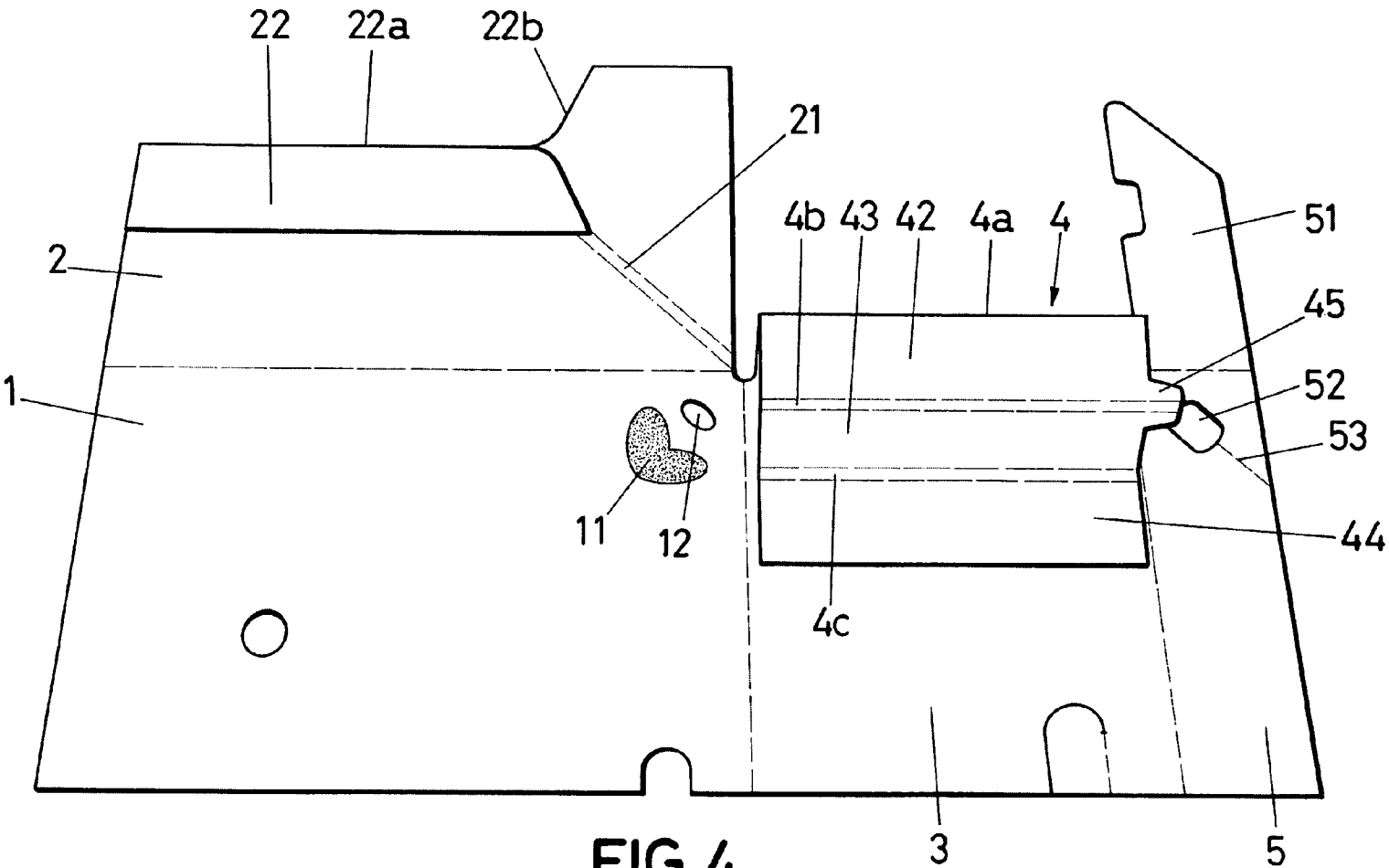

In FIG. 4, one can observe how the upper part 22 of the side wall 2 has been folded and affixed (with adhesive) on the inside face of said side wall, about the fold line 22*a*.

Figure 5:
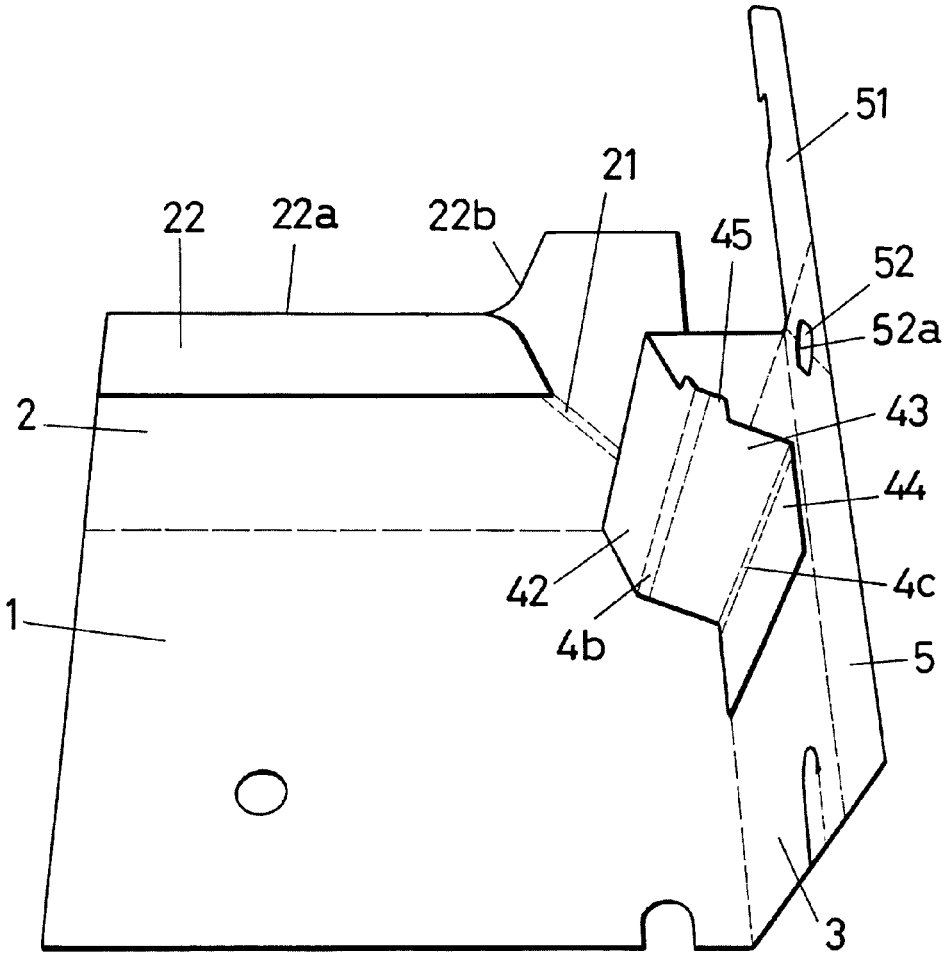

In FIG. 5 the tray is observed after a following phase of the procedure for obtaining the same (according to this preferred embodiment of the invention); the end wall 3 has been folded or inclined through approximately 90° about its fold line with respect to the base 1.

Figure 6:
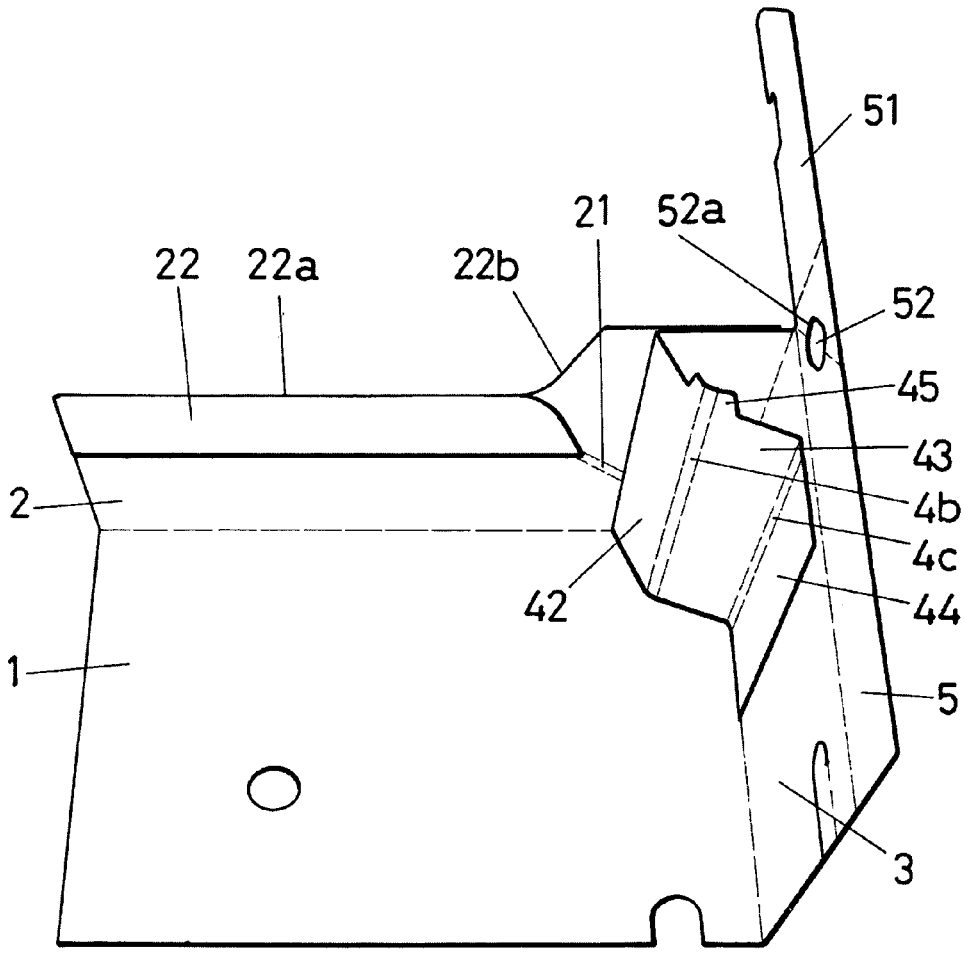

In FIG. 6, it is observed how the side wall 2 has also been folded or inclined through approximately 90° about its fold line with respect to the base 1, and how a first segment 41 of the corner pillar has been affixed (with adhesive) to the inside face of the side wall. Now, as can be deduced from FIG. 6, the position of the "kinked hypotenuse" formed by the intermediate segments 42 and 43 determines if it is possible to fold the end wall and the side wall toward the inside of the tray.

Figure 7:
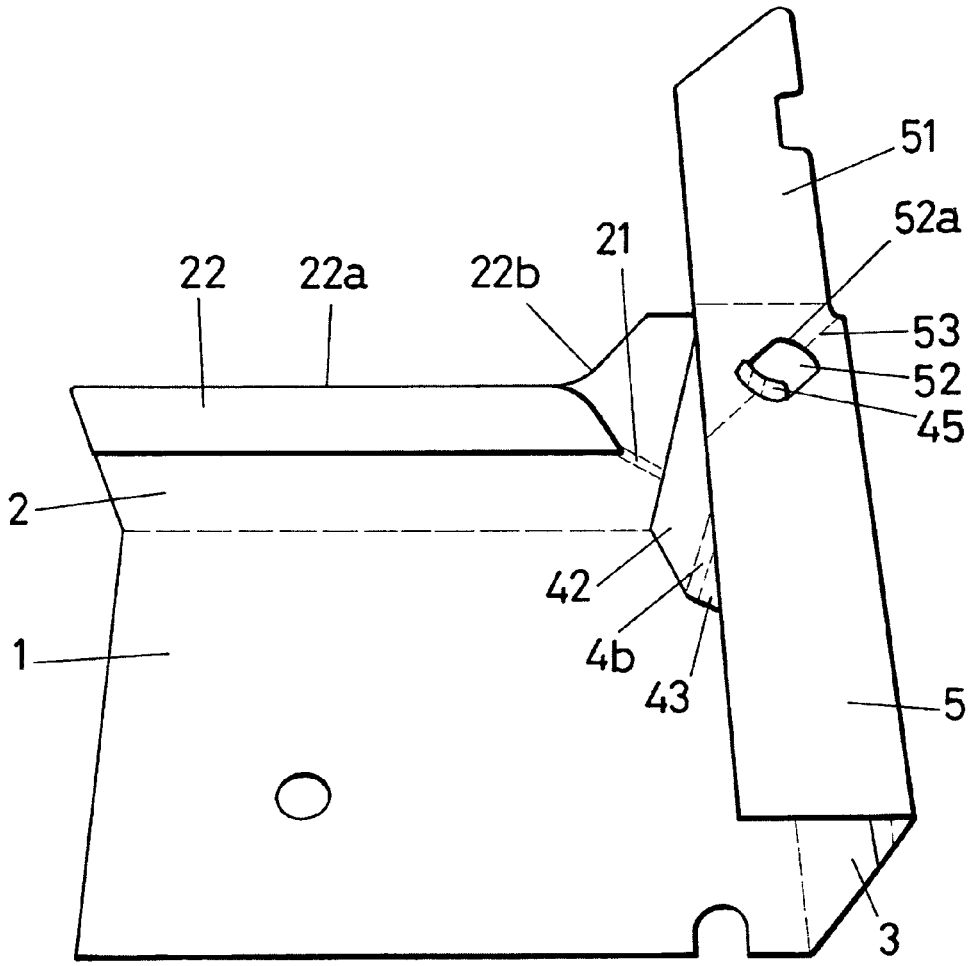
Figure 8:
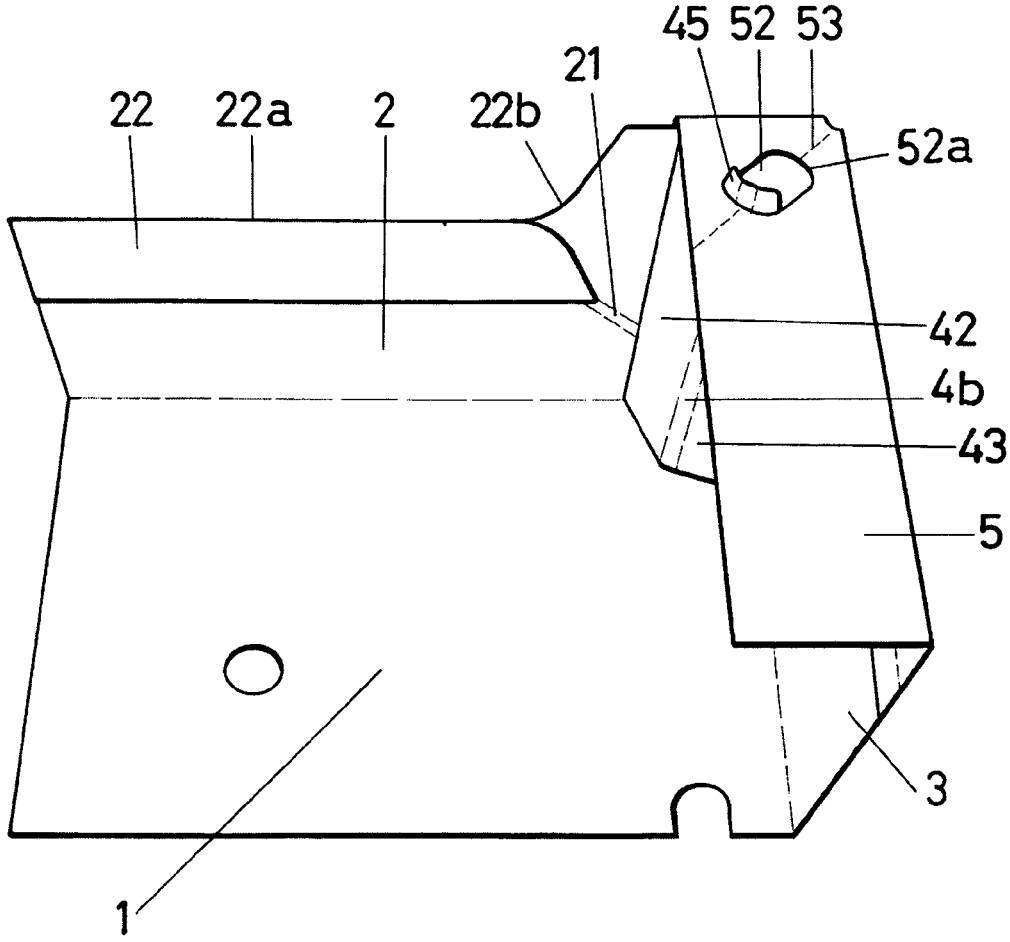

In the following step, illustrated in FIG. 7, the flap 5 has been folded through approximately 90° about its fold line with respect to the end wall 3 proper; the prolongation 45 of the intermediate segments 42, 43 of the corner pillar project through the hole 52 of the flap 5. Subsequently, the ends 51 of each flap are folded and abut against the outside face of the corresponding side wall 2, to which they are affixed with adhesive. The result is illustrated in FIG. 8.

Figure 9:
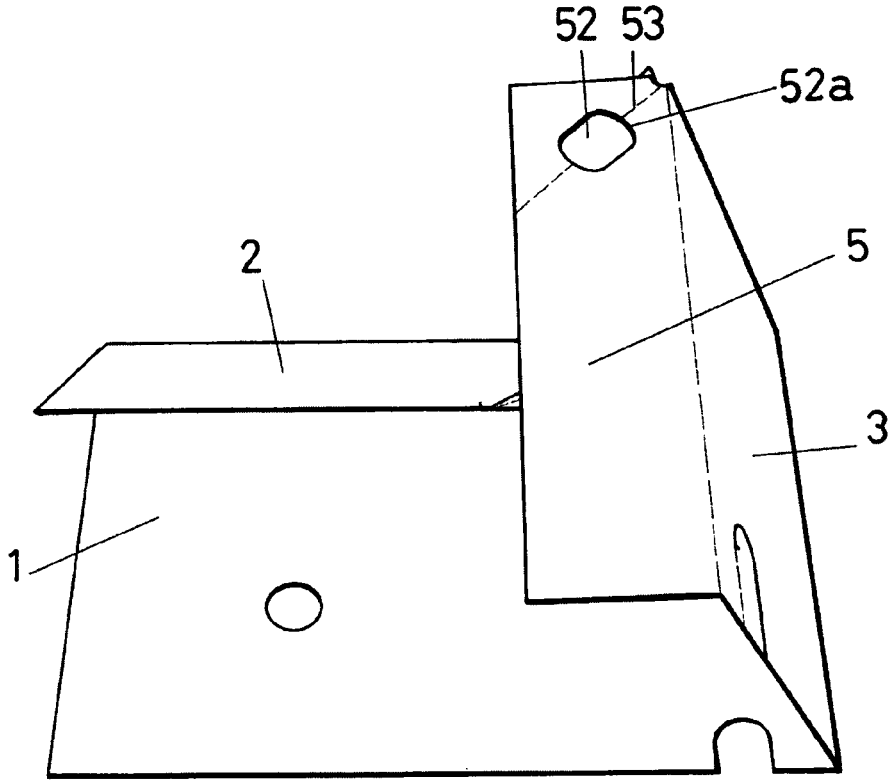
Figure 10:
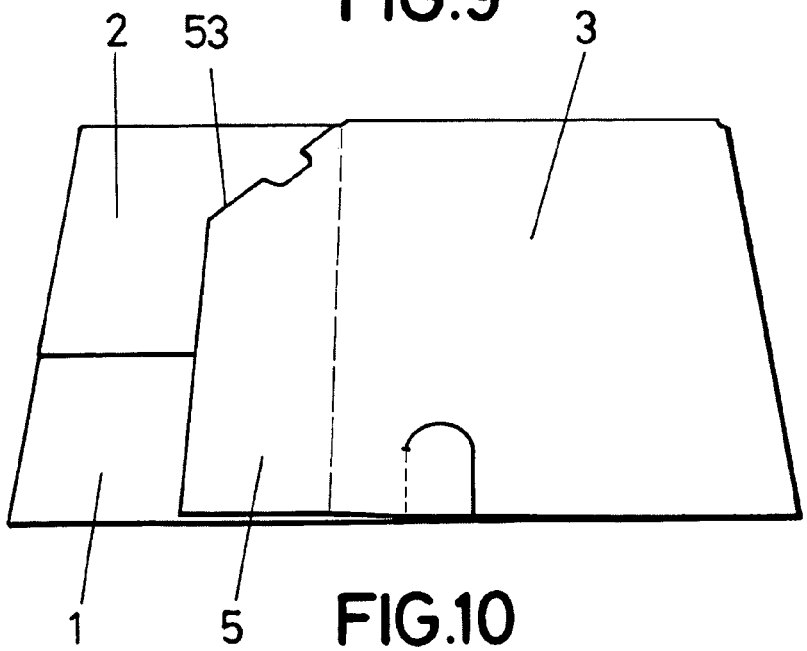

Now, as is shown in FIG. 9, the side walls are folded inwards, over the base 1, and the end walls are folded inwards, over the side walls, whereby the folded, substantially flat tray is obtained, as is illustrated in FIG. 10. Here, during this folding phase, the lower edges of the intermediate segments 42, 43 of the corner pillars slide on the silicone deposited on the areas 11 of the base, facilitating the folding action.

Figure 11:
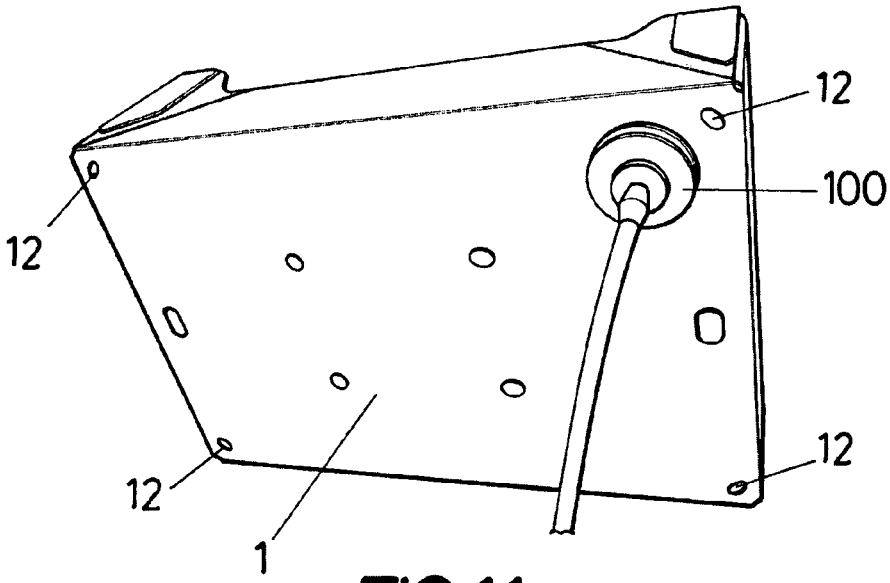
FIGS. 11 and 12. —They show schematically the use of suction pads on the bottom of the tray, so that it is curved downwards.
Figure 12:
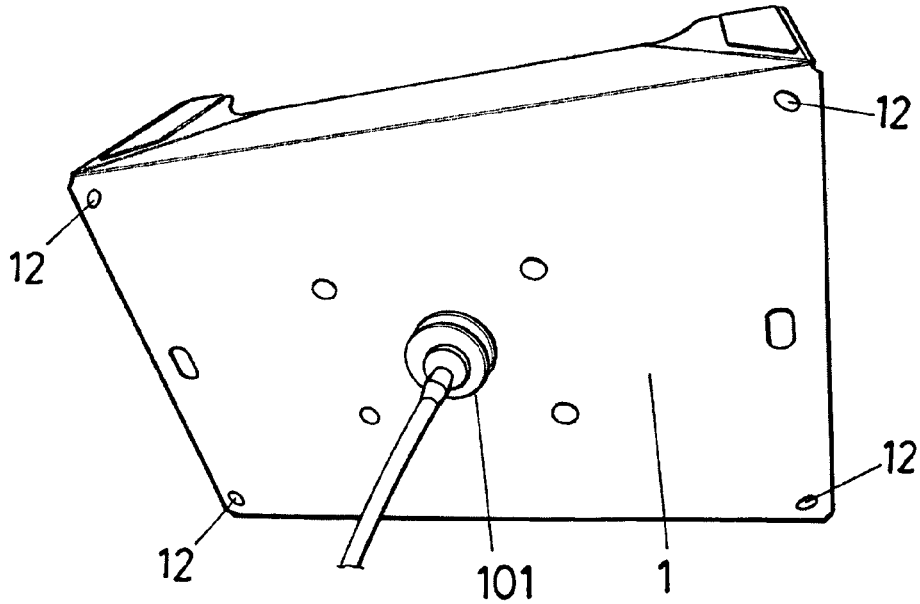

FIGS. 11 and 12 illustrate schematically how suction pads (100, 101) can be used to "suck" the base (or part of the base) during the process of folding the tray. In this way, it is possible to avoid or reduce the friction between the lower edges of the intermediate segments 42, 43 and the inside surface of the base 1, during folding.

Figure 13:
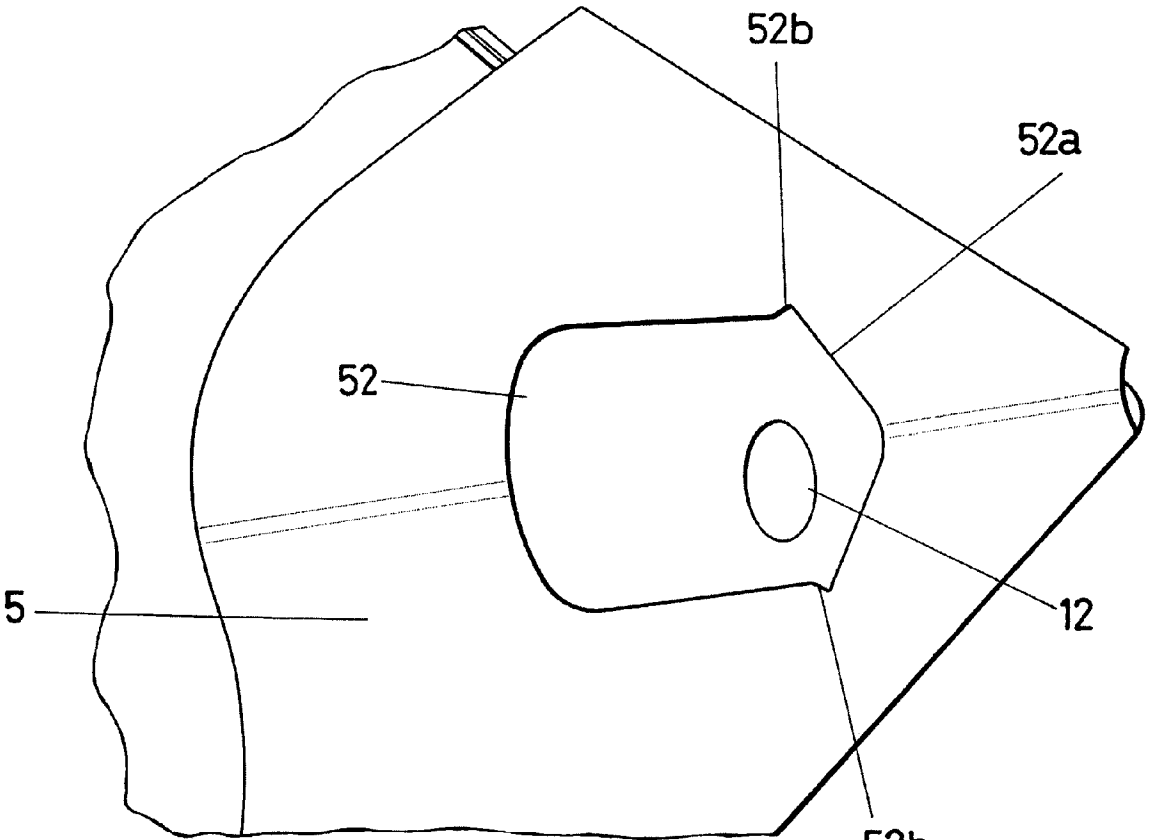
FIGS. 13 and 14. —They show a view of a hole of a flap, in accordance with a possible embodiment of the invention.
Figure 14:
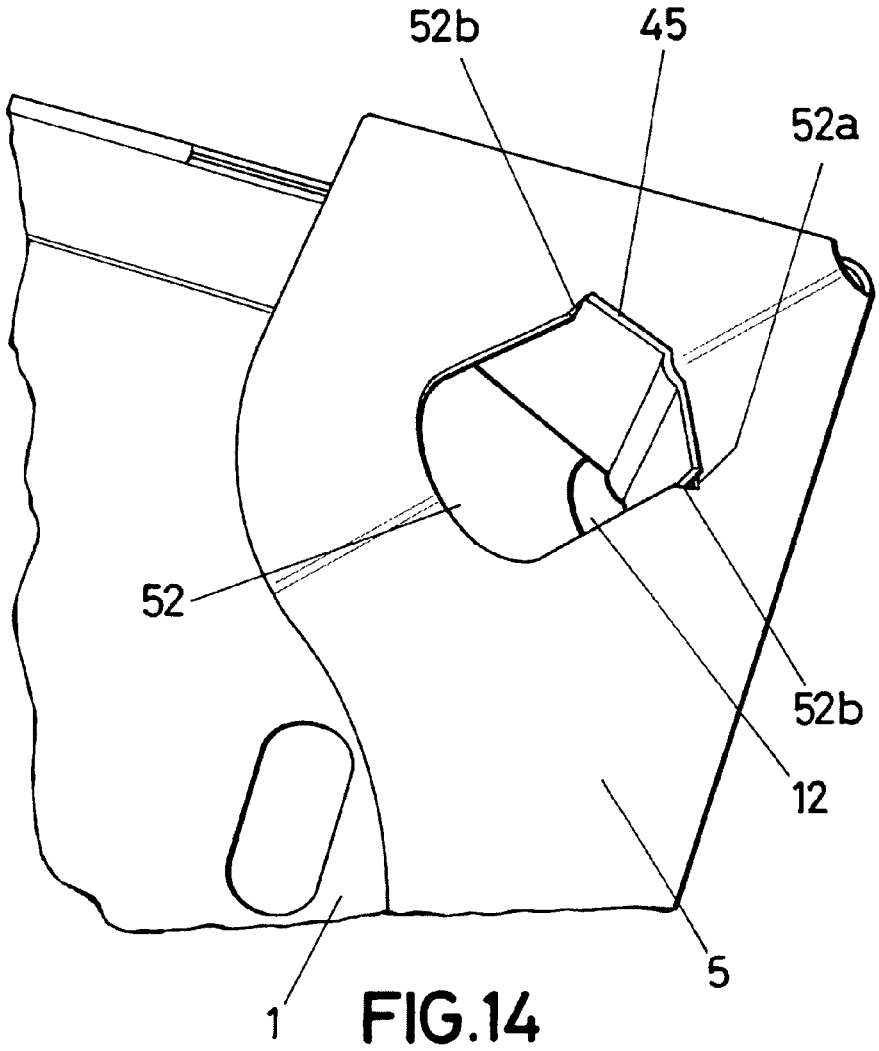

FIGS. 13 and 14 show a hole 52 of one of the flaps of the tray. The hole 52, in correspondence with an edge 52*a* of the hole, has two notches 52*b* in the side of the hole, configured to retain the longitudinal edges of the prolongation 45 of the corresponding corner pillar, such as can be observed in FIG. 14. Thus, these notches can retain the intermediate segments of the corner pillar in their first position, avoiding the accidental collapse of the tray.

Figure 15:
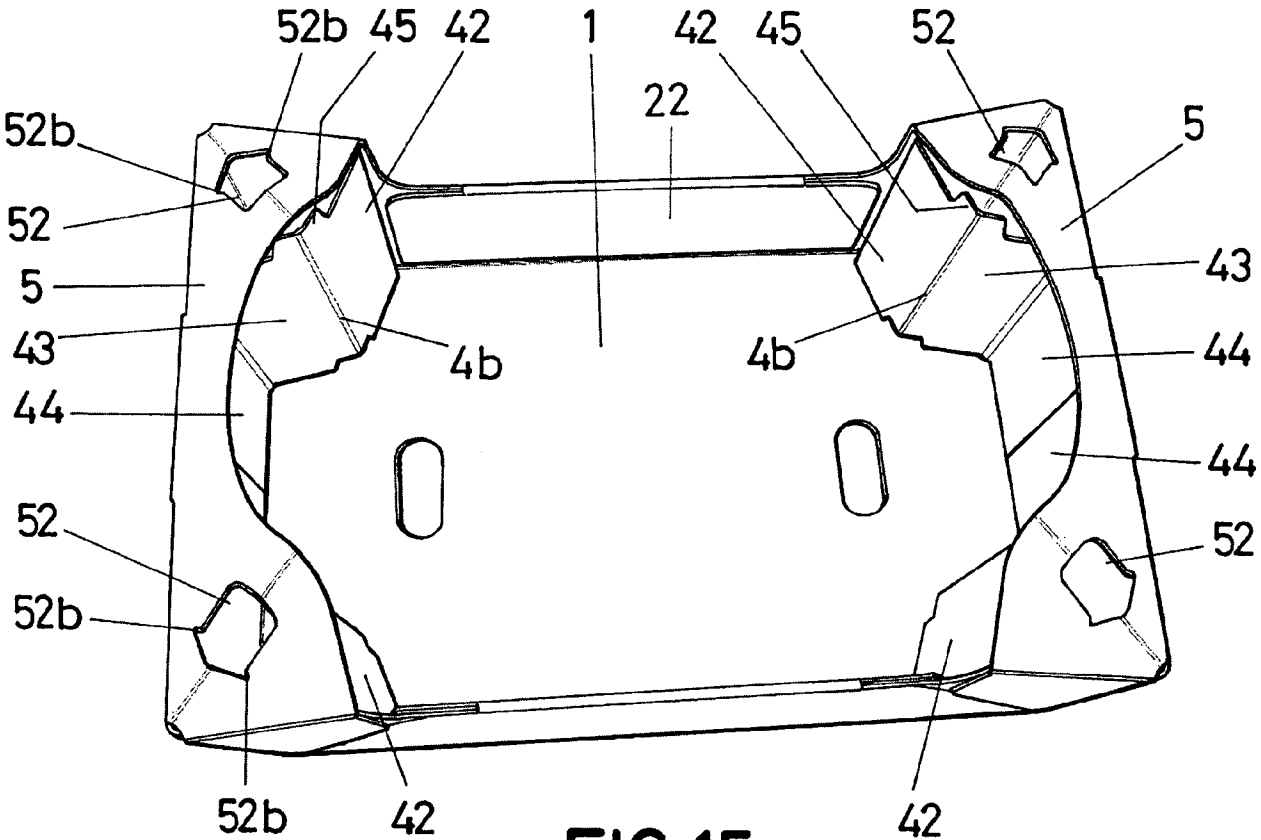
FIGS. 15 and 16. —They show a top view in perspective of a tray in accordance with this embodiment of the invention.
Figure 16:
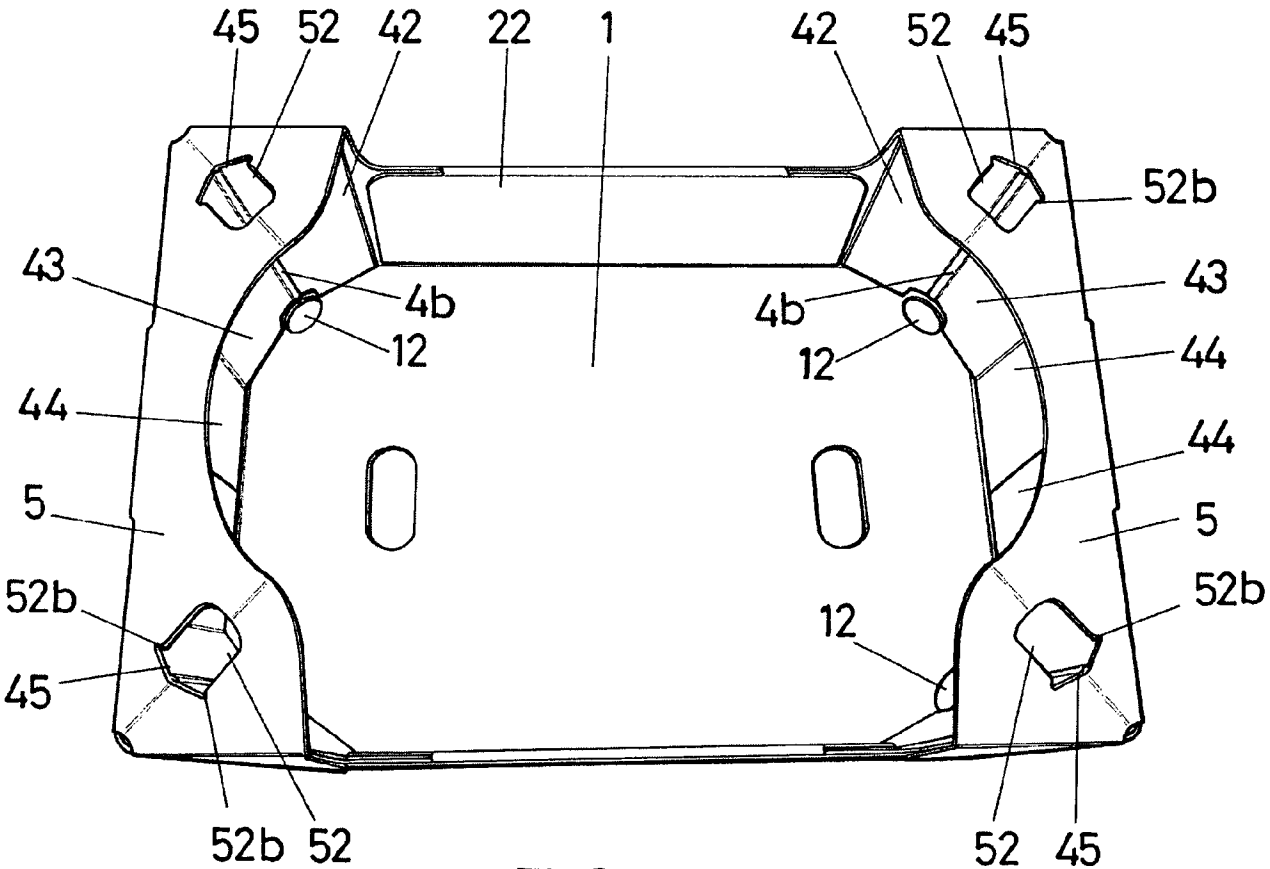

In FIGS. 15 and 16 the tray can be observed; in FIG. 15, the intermediate segments (42, 43) of the corner pillars are in the second position, that which allows the tray to collapse by simply pulling the walls of the tray toward the inside of the tray. In FIG. 16, the intermediate segments (42, 43) of the corner pillar have adopted their first position, blocking the walls and preventing the tray from collapsing. In this position, the prolongations 45 fit in the notches 52*b* of the corresponding holes 52.

Thus, it is achieved for example that the stabilization of the trays (in the "blocked" or "stabilized" position in which the corner pillars are in their first position) is produced automatically when carrying out the stacking of the trays. Specifically, when the trays have been mounted, that is, erected, the prolongations 45 of each corner pillar are housed in the corresponding holes 52 of the flap 5. However, this flap 5 is not perfectly horizontal, but a little bowed, by the inherent stress of the tray. This allows the prolongations 45 which are slightly wedged in shape (their free end is a little narrower than their base where it joins the corner pillar), to slide easily within the hole 52, passing easily from the second position to the first position of the intermediate segments of the corner pillars. When the trays are stacked, the upper tray, resting on a lower tray, makes the flap 5 of the lower tray adopt a horizontal position, so that the edge 52*a* of the hole 52 is positioned confronting the prolongation 45 in a plane in which the prolongation 45 has more width. Thus the prolongation 45 is engaged against the edges of the hole 52 and, also, retained by the notches 52*b* of the hole 52. Thus the prolongation can no longer slide freely within the hole 52 but instead it is retained in the position which corresponds to the first position of the intermediate segments of the corner pillar.

In this text, the word "comprises" and variants thereof (like "comprising", etc.) are not to be interpreted in an exclusive manner, that is, they do not exclude the possibility of that described including other elements, steps, etc.

Furthermore, the invention is not limited to the specific embodiments which have been described but it also includes, for example, the variants that can be carried out by the average expert in the matter (for example, with regard to the election of materials, dimensions, components, configuration, etc.), within that which is deduced from the claims.

The invention claimed is:

1. A self-mounting and collapsible tray obtainable from a stamped sheet, the tray comprising: a base (1), two side walls (2) and two end walls (3), the tray also comprising four corners in correspondence with which the side walls (2) are joined to the end walls (3), the tray comprising, in correspondence with each corner, a corner pillar formed from a side prolongation (4) of the corresponding end wall (3) of the tray, said side prolongation (4) of the end wall comprising at least four segments (41-44) separated by fold lines, of which at least one first segment (41) is affixed to the corresponding side wall (2), at least two intermediate segments (42, 43) constitute a part of the corner pillar which extends between the side wall (2) and the end wall (3) of the tray in the erect position, and at least one last segment (44) is affixed to the end wall, so that, with the tray in the erect position, said intermediate segments (42, 43) can be located in a first position in which the corner pillars lock the tray in its erect position, and a second position in which they allow the tray to be folded, the side walls and the end wall being folded toward the base (1);

said last segment (44) is affixed to the end wall so that at least one part of the last segment extends from one of the intermediate segments (43) and toward a centre of the end wall, distancing itself from the corresponding corner of the tray, and in that wherein the tray also comprises, in correspondence with each end wall (3), a transversal flap (5) constituted by at least one part of a prolongation of the end of the end wall that corresponds to the upper part of the end wall of the tray in the erect position, said transversal flap (5) having two ends (51), each one folded over and affixed to an outside face of the corresponding side wall (2) wherein each of said transversal flaps (5) has, in correspondence with each corresponding corner pillar, a hole (52);

wherein each corner pillar has, in correspondence with an upper edge of the intermediate segments (42, 43), a prolongation (45) configured to extend through the corresponding hole (52), in the erect position of the tray;

wherein the holes (52) of the transversal flap (5) and the prolongations (45) of the corner pillars are configured so that, with the tray in the erect position, the prolongations (45) are horizontally displaceable within the holes, so that by pressing on the prolongations (45) the intermediate segments (42, 43) of the corner pillars can be displaced between the first position and the second position.

2. Tray in accordance with claim 1, wherein each of said flaps (5) has a substantially horizontal surface in the tray in the erect position.

3. Tray in accordance with claim 2, wherein said substantially horizontal surface is located at the level of the upper edge of the corresponding end wall (3).

4. Tray in accordance with claim 1, wherein the tray has, in its base and in correspondence with each corner pillar, a through-hole (12) configured so that, when a first tray is stacked on an identical second tray, said through-hole (12) of the first tray receives the prolongation (45) of the upper edge of the intermediate segments of said second tray.

5. Tray in accordance with claim 4, wherein the hole (52) which each transversal flap (5) has in correspondence with each corresponding corner pillar, is located and configured so that when the intermediate segments (42, 43) are in the first position in which the corner pillars lock the tray in its erect position, an edge (52*a*) of said hole (52) acts as a butt against the prolongation (45) of the upper edge of the intermediate segments, so that said prolongation (45) tends to incline toward the centre of the tray.

6. Tray in accordance with claim 1, wherein the hole (52) which each flap (5) has in correspondence with each corner pillar is configured to retain the prolongation (45) of the corresponding corner pillar in the first position of the intermediate segments (42, 43) of the corner pillar, impeding said intermediate segments from passing from the first position to the second position.

7. A self-mounting and collapsible tray, obtainable from a stamped sheet, the tray comprising:

a base (1), two side walls (2) and two end walls (3), the tray also comprising four corners in correspondence with which the side walls (2) are joined to the end walls (3), in correspondence with each corner, a corner pillar formed from a side prolongation (4) of the corresponding end wall (3) of the tray, said side prolongation (4) of the end wall comprising at least four segments (41-44) separated by fold lines, of which at least one first segment (41) is affixed to the corresponding side wall (2), at least two intermediate segments (42, 43) constitute a part of the corner pillar which extends between the side wall (2) and the end wall (3) of the tray in the erect position, and at least one last segment (44) is affixed to the end wall, so that, with the tray in the erect position, said intermediate segments (42, 43) can be located in a first position in which the corner pillars lock the tray in its erect position, and a second position in which they allow the tray to be folded, the side walls and the end wall being folded toward the base (1);

said last segment (44) is affixed to the end wall so that at least one part of the last segment extends from one of the intermediate segments (43) and toward a centre of the end wall, distancing itself from the corresponding corner of the tray, and in that wherein the tray also comprises, in correspondence with each end wall (3), a transversal flap (5) constituted by at least one part of a prolongation of the end of the end wall that corresponds to the upper part of the end wall of the tray in the erect position, said transversal flap (5) having two ends (51), each one folded over and affixed to an outside face of the corresponding side wall (2);

wherein each of said transversal flaps (5) has, in correspondence with each corresponding corner pillar, a hole (52);

wherein each corner pillar has extending from an upper edge of the intermediate segments (42, 43), a prolongation (45) configured to extend through the corresponding hole (52), in the erect position of the tray;

wherein the hole (52) which each transversal flap (5) has in correspondence with each corner pillar is configured to retain the prolongation (45) of the corresponding corner pillar in the first position of the intermediate segments (42, 43) of the corner pillar, impeding said intermediate segments from passing from the first position to the second position; wherein said hole (52) has, in correspondence with an edge (52*a*) of the hole, two notches (52*b*) configured to retain the prolongation (45) of the corresponding corner pillar, impeding that the intermediate segments of the corner pillar pass from the first position to the second position.

8. Tray in accordance with claim 1, wherein the transversal flaps have, in correspondence with each corner of the tray, a fold line which extends at an angle from the corresponding corner, passing through the corresponding hole (52).

9. Tray according to claim 1, wherein each side wall (2) has, in correspondence with each corner, a fold line (21) which extends at an angle from the corresponding corner, toward an upper edge of the side.

10. Tray according to claim 1, wherein each side wall (2) has a part of longitudinal reinforcement which comprises an upper part (22) of at least one part of the side, folded over a face of the side wall and at least partially affixed to the same, with adhesive.

11. Tray according to claim 1, which is made of cardboard.

12. Tray according to claim 1, which has, on an inside surface of the base (1) and in correspondence with each of the corner pillars (4), at least one area (11) coated with a material which has a surface with a coefficient of friction lower than the coefficient of friction of the rest of the inside surface of the base (1).

13. Tray according to claim 12, in which said material is silicone.

14. Tray in accordance with claim 7, wherein each of said transversal flaps (5) has a substantially horizontal surface in the tray in the erect position.

15. Tray in accordance with claim 14, wherein said substantially horizontal surface is located at the level of the upper edge of the corresponding end wall (3).

16. Tray in accordance with claim 7, wherein the tray has, in its base and in correspondence with each corner pillar, a through-hole (12) configured so that, when a first tray is stacked on an identical second tray, said through-hole (12) of the first tray receives the prolongation (45) of the upper edge of the intermediate segments of said second tray.

17. Tray in accordance with claim 16, wherein the hole (52) which each transversal flap (5) has in correspondence with each corresponding corner pillar, is located and configured so that when the intermediate segments (42, 43) are in the first position in which the corner pillars lock the tray in its erect position, an edge (52*a*) of said hole (52) acts as a butt against the prolongation (45) of the upper edge of the intermediate segments, so that said prolongation (45) tends to incline toward the centre of the tray.

18. Tray in accordance with claim 7, wherein the transversal flaps have, in correspondence with each corner of the tray, a fold line which extends at an angle from the corresponding corner, passing through the corresponding hole (52).

19. Tray according to claim 7, wherein each side wall (2) has, in correspondence with each corner, a fold line (21) which extends at an angle from the corresponding corner, toward an upper edge of the side.

20. Tray according to claim 7, wherein each side wall (2) has a part of longitudinal reinforcement which comprises an upper part (22) of at least one part of the side, folded over a face of the side wall and at least partially affixed to the same, with adhesive.

21. Tray according to claim 7, which is made of cardboard.

22. Tray according to claim 7, which has, on an inside surface of the base (1) and in correspondence with each of the corner pillars (4), at least one area (11) coated with a material which has a surface with a coefficient of friction lower than the coefficient of friction of the rest of the inside surface of the base (1).

23. Tray according to claim 22, in which said material is silicone.

* * * * *